US010641024B2

(12) United States Patent
Wypych et al.

(10) Patent No.: US 10,641,024 B2
(45) Date of Patent: May 5, 2020

(54) EASY GLIDE STORM DOOR

(71) Applicant: Zdzislaw Stanislaw Wypych, Jackson, MI (US)

(72) Inventors: Zdzislaw Stanislaw Wypych, Jackson, MI (US); William Terrance Carless, Jackson, MI (US)

(73) Assignee: Zdzislaw Stanislaw Wypych, Jackson, MI (US)

( * ) Notice: Subject to any disclaimer, the term of this patent is extended or adjusted under 35 U.S.C. 154(b) by 0 days.

(21) Appl. No.: 16/140,692

(22) Filed: Sep. 25, 2018

(65) Prior Publication Data

US 2019/0024425 A1 Jan. 24, 2019

Related U.S. Application Data

(62) Division of application No. 14/874,733, filed on Oct. 5, 2015, now Pat. No. 10,125,528.

(60) Provisional application No. 62/059,312, filed on Oct. 3, 2014.

(51) Int. Cl.
*E05D 15/06* (2006.01)
*E06B 3/46* (2006.01)

(52) U.S. Cl.
CPC ..... *E05D 15/0652* (2013.01); *E05D 15/0656* (2013.01); *E06B 3/4636* (2013.01); *E05D 15/0639* (2013.01)

(58) Field of Classification Search
CPC ..... E05D 15/0652; E05D 15/0656; E05D 15/0626; E05D 15/0634; E05D 15/1021; E05D 15/0639; E06B 3/4636; E05Y 2600/46; E05Y 2201/684; E05Y 2201/64
USPC ..... 52/207, 204.51; 16/95 R, 94 R
See application file for complete search history.

(56) References Cited

U.S. PATENT DOCUMENTS

| | | | | |
|---|---|---|---|---|
| 923,706 A | | 6/1909 | Richey et al. | |
| 1,036,589 A | * | 8/1912 | Eggleston | E05D 15/0613 16/95 R |
| 1,051,426 A | * | 1/1913 | Matheson | 16/94 R |
| 1,329,461 A | * | 2/1920 | Frantz | E05D 15/0652 16/95 R |
| 1,485,200 A | * | 2/1924 | Roberts | 49/409 |
| 1,488,378 A | * | 3/1924 | Carroll | B61D 19/005 16/95 R |
| 1,689,665 A | * | 10/1928 | Cramp | E05D 15/0639 16/103 |

(Continued)

OTHER PUBLICATIONS

Sliding Door Track C-412, KNC K.N. Crowder Mfg, Inc., 2 pages, dated May 27, 2015 http://www.kncrowder.com/slidingdoor/c412.php.

(Continued)

*Primary Examiner* — Brent W Herring

(74) *Attorney, Agent, or Firm* — The Dobrusin Law Firm, P.C.

(57) ABSTRACT

A method of installing a storm door is disclosed. The method includes the steps of: attaching a track to a door head; attaching one or more rollers to the track; and attaching the storm door to the one or more rollers. After the storm door is installed, the storm door can be slid along a length of the track between an open position and a closed position. While sliding the storm door between the open position and the closed position, the storm door remains generally parallel to the door head.

17 Claims, 4 Drawing Sheets

(56) References Cited

U.S. PATENT DOCUMENTS 1,752,025 A * 3/1930 Peterson ..... B66B 13/30 16/95 R
1,791,527 A 2/1931 Hoffman
2,710,422 A * 6/1955 Nelson ..... E05D 15/0634 16/105
2,732,919 A * 1/1956 Johnson ..... E05D 15/0652 49/372
2,761,172 A 9/1956 Jorgensen et al.
2,843,872 A * 7/1958 Hannon ..... E05D 15/0634 16/105
2,847,726 A 8/1958 Frick
3,039,153 A * 6/1962 Dusing ..... E05D 15/10 49/409
3,118,170 A * 1/1964 Zollinger ..... E05D 15/063 16/105
3,261,129 A * 7/1966 Brydolf ..... E05D 15/06 49/411
3,327,428 A 6/1967 Horton et al.
3,416,183 A 12/1968 Martin
3,473,266 A 10/1969 Miller
3,480,989 A 12/1969 Edeus
3,611,637 A * 10/1971 Saino ..... E05D 15/1021 49/235
3,636,588 A * 1/1972 Ferris ..... E05D 15/0652 16/94 R
3,829,929 A * 8/1974 Foltz ..... E05D 15/063 16/97
3,916,477 A 11/1975 Baker
4,081,880 A 4/1978 Edeus
4,325,204 A * 4/1982 Martine ..... E06B 3/4654 49/372
4,404,770 A * 9/1983 Markus ..... E05D 15/1021 49/235
4,424,605 A * 1/1984 Squires ..... E05D 15/0652 16/94 R
4,452,014 A * 6/1984 Markus ..... E05F 15/646 49/360
4,476,652 A * 10/1984 Beauchot ..... E05D 15/063 16/106
4,488,387 A * 12/1984 Foti ..... E06B 7/22 49/425
4,513,535 A 4/1985 Uphoff
4,619,075 A * 10/1986 Wiles ..... E05D 15/1021 49/235
4,633,614 A 1/1987 Van Weelden
4,651,469 A * 3/1987 Ngian ..... E05D 15/1021 16/87 R
4,680,828 A * 7/1987 Cook ..... E05D 15/0634 16/102
4,742,645 A 5/1988 Johnston
4,801,880 A 1/1989 Koike
4,845,807 A * 7/1989 Rooney ..... E05D 15/0652 16/94 R
4,852,628 A * 8/1989 Klein ..... E05D 15/26 160/199
4,881,346 A 11/1989 Block
4,936,049 A * 6/1990 Hansen ..... E05D 15/565 49/209
5,079,872 A 1/1992 Short
5,301,468 A * 4/1994 Kamezaki ..... E05D 15/1021 49/209
5,351,442 A * 10/1994 Gingras ..... E05D 15/1042 49/411
5,450,693 A 9/1995 Tarrega
5,461,829 A 10/1995 Lehto et al.
5,566,505 A * 10/1996 Kamezaki ..... E05D 15/1021 49/225
5,742,979 A * 4/1998 Garcia-Hernando ..... E05D 15/08 16/95 R
6,082,499 A 7/2000 O'Donnell
6,209,171 B1 * 4/2001 Pelletier ..... E05D 15/063 16/87 R
6,250,016 B1 6/2001 Gravel
6,289,643 B1 * 9/2001 Bonar ..... E06B 3/4654 49/505
6,336,247 B1 1/2002 Schnoor
6,647,590 B2 11/2003 Haab et al.
6,871,448 B1 * 3/2005 Kline ..... E06B 7/28 49/319
6,983,512 B2 * 1/2006 De Oliveira ..... E05D 15/063 16/87 R
7,117,559 B1 * 10/2006 Barber ..... E05D 15/063 16/97
7,712,258 B2 5/2010 Ewing et al.
7,743,557 B2 6/2010 Liao
7,779,578 B2 8/2010 Gray
8,375,638 B2 * 2/2013 Martin ..... E04B 2/827 49/409
8,443,549 B2 5/2013 Salvietti et al.
8,579,006 B2 * 11/2013 Levin ..... E04B 2/827 160/184
8,584,317 B2 11/2013 Liebscher et al.
9,091,106 B2 * 7/2015 Allen ..... E05D 15/0652
9,145,730 B1 * 9/2015 Santamaria ..... E06B 5/11
9,234,376 B2 * 1/2016 Trulaske, Sr. ..... E05D 13/14
9,926,735 B2 * 3/2018 Goossens ..... E05F 17/00
2002/0104373 A1 * 8/2002 Ishihara ..... E05F 15/44 340/556
2005/0000164 A1 1/2005 Jacobs
2005/0235571 A1 * 10/2005 Ewing ..... E05C 7/06 49/410
2006/0277850 A1 12/2006 Gravel et al.
2007/0283640 A1 * 12/2007 Shivak ..... E04B 2/7455 52/207
2008/0092450 A1 * 4/2008 Balduck ..... E05D 15/0652 49/404
2010/0242370 A1 * 9/2010 Trulaske, Sr. ..... E05D 13/14 49/410
2018/0023336 A1 * 1/2018 Groff ..... E06B 3/4636 49/410
2018/0148966 A1 * 5/2018 Sakabe ..... E05D 15/565

OTHER PUBLICATIONS

Pocket Door Rollers Center Hung, BB 163208 Ball Bearing Hanging Door Hardware, 13 pages, dated May 27, 2015 http://hangingdoorhardware.com/pocketdoors/pocketrollers.htm.

Sliding Door Weatherstrip Brush Seals, Weather Proof Designs Hanging Door Hardware, 3 pages, dated May 27, 2015 http://hangingdoorhardware.com/pocketdoors/weatherstrip/weatherstrip.htm.

* cited by examiner

EASY GLIDE STORM DOOR

FIELD

These teachings relate generally to a closure for a passage such as the entrance to a living space, and in particular to a storm door positioned in front of a main door.

BACKGROUND

A house or apartment generally includes a storm door having glass panels and window screen panels in front of an exterior door. The storm door provides visibility outside of the exterior door through the glass or screen panels and allows ventilation through the window screen panels. Also, the storm door protects the exterior door from bad weather and thereby helps to prevent infiltration from a strong rush of wind or rain.

Typically, a storm door has the general appearance of a swinging door, that is a door panel suspended on hinges within a door frame. When a person standing outside opens the storm door, the storm door swings cm the hinges toward the person so that the person must back away from the opening. This outward swinging action of the typical storm door requires there to be a clear space in front of the doorway equal to about the width of the storm door. In areas where snow is prevalent, snow builds up in front of the door making it difficult or in extreme cases, impossible to open the door. For instance, a 36" prior art storm door must displace 36" distance of swing worth of snow. It is not unheard of where a person must use a different exit from their home and then must shovel clear their storm door so it will open.

When a prior art storm door is located at the top of a set of stairs, a person opening the storm door must step backward, usually descending a step or two, in order to provide the needed swinging clearance for the storm door open. Stepping backward on a set of stairs can be awkward, especially for the elderly, the infirm and the very young. This difficulty is compounded if the person is carrying groceries or other objects.

Another difficulty encountered with prior art storm doors is prompted by the common return spring system fitted to swinging storm doors. A person attempting to enter through a doorway closed by both a storm door and a main door must hold the storm door open against its return spring with their elbow, hand or body. This action can be especially cumbersome for a person with a physical handicap or carrying a load.

Furthermore, a prior art storm door sometimes can be caught by gusts of wind, which may cause severe damage to the door and/or the doorjamb to which it is hinged.

There is therefore a need for an improved storm door that overcomes these shortcomings found in prior art storm door systems.

SUMMARY

A method of installing a storm door is disclosed. The method comprises one or more steps including: attaching a track to a door head; attaching one or more rollers to the track; and attaching the storm door to the one or more rollers. After the storm door is installed, the storm door can be slid along a length of the track between an open position and a closed position. While sliding the storm door between the open position and the closed position, the storm door remains generally parallel to the door head.

A method is disclosed comprising the steps of retrofitting a swinging storm door into a storm door that slides comprising one or more steps of, attaching a wall bracket to a door head; attaching a track to the wall bracket; attaching one or more rollers to the track; attaching a door bracket to the swinging storm door and attaching the door bracket to the one or more rollers. After the door bracket is attached to the one or more rollers, the storm door can be slid along a length of the track between an open position and a closed position. After the door bracket is attached to the one or more rollers, the storm door is restricted from swinging.

An assembly is disclosed, comprising: a wall bracket configured to attach to a door head; a track connected to the wall bracket, a roller fit within the track so that the roller is moveably connected to the track; a door bracket connected to the roller so that the door bracket moves with the roller during sliding; a lower guide attached to a bottom sill and slidably receiving at least a portion of a storm door and a top guard attached to a portion of the storm door and the track so that a gap defined between the storm door and the track is closed out. The roller can be slid within the track so that the storm door can be slid along a path that is generally parallel to the door head and is restricted from swinging relative to the door head.

DETAILED DESCRIPTION

The explanations and illustrations presented herein are intended to acquaint others skilled in the art with the teachings its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

This disclosure claims priority to U.S. Provisional Patent Application No. 62/059,312 filed on Oct. 3, 2014, the contents of which is hereby incorporated by reference herein in its entirety for all purposes.

The present invention provides an improved storm door that overcomes the disadvantages present in prior art swinging storm doors. The improved storm door of this invention can be used without requiring a swing space. The improved storm door can be easily opened even by a person carrying groceries or who is physically handicapped. Furthermore, the improved storm door remains parallel to a wall of the dwelling, such that wind is less likely to catch and thrust open the storm door. The present invention can be installed as a retrofit item in an existing door opening with minimum modification.

Figure 1:
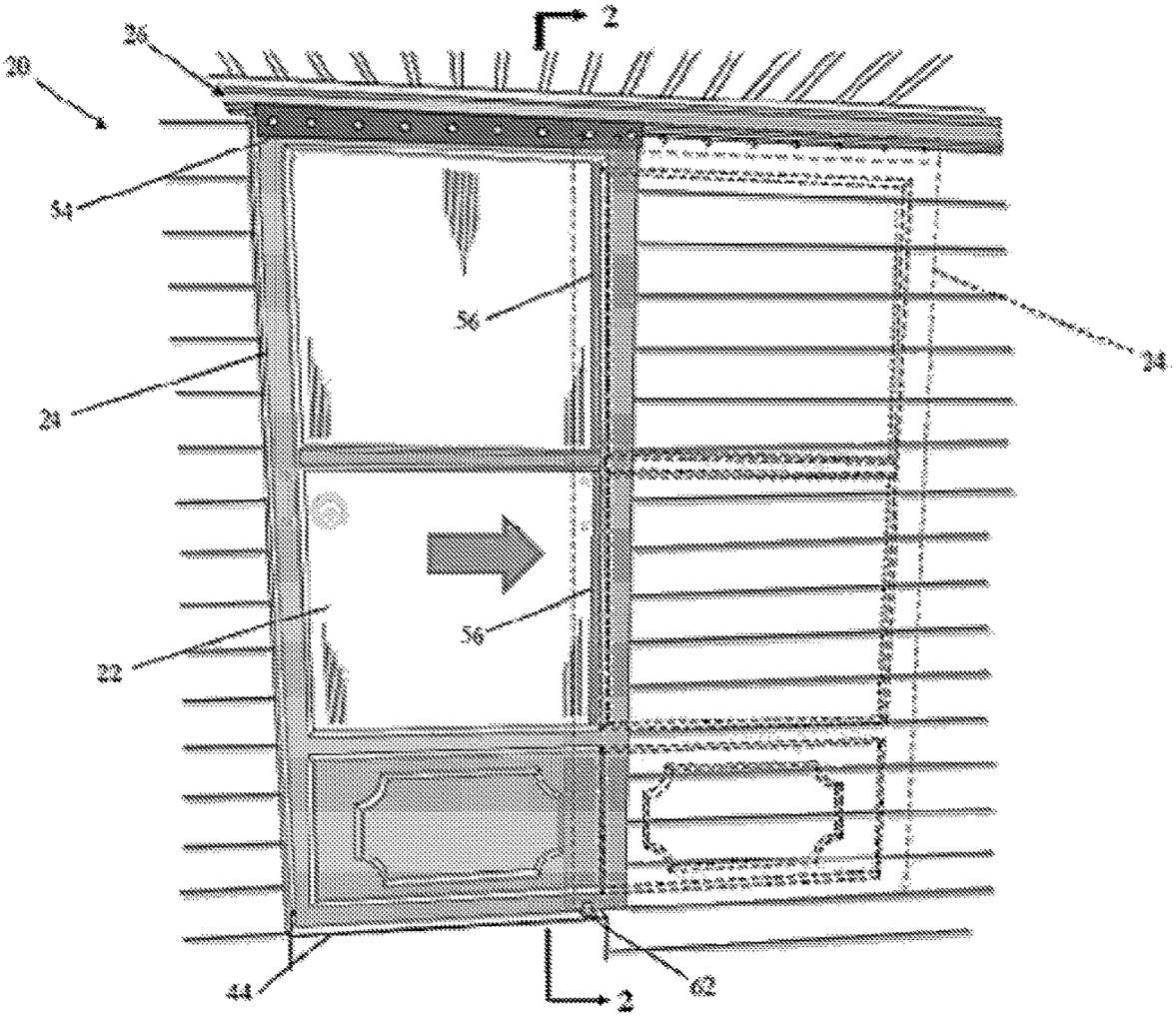
FIG. 1 is a perspective view of the easy glide door assembly in front of a standard exterior entry door

Referring to FIG. 1, an easy glide storm door assembly according to one exemplary embodiment of the invention is generally shown at 20 installed in front of a standard exterior entry door 22. The door assembly 20 comprises a door 24. One exemplary of the door 24 is shown having glass panels which are replaceable with screen panels. The shape and arrangement of the door 24 could, however, be of any suitable type and may or not may not correspond to the shape of the exterior door 22. The door 22 is suspending from above by a roller track system, generally indicated at 26. The door 24 is thus configured to slide to one side following in the roller track system 26 so that the user does not need to step back in order to open the door 24. The door 24 can therefore slide easily to one side, and stay in the open condition without further restraint, thus permitting easy and total access to the exterior door 22.

Figure 2:
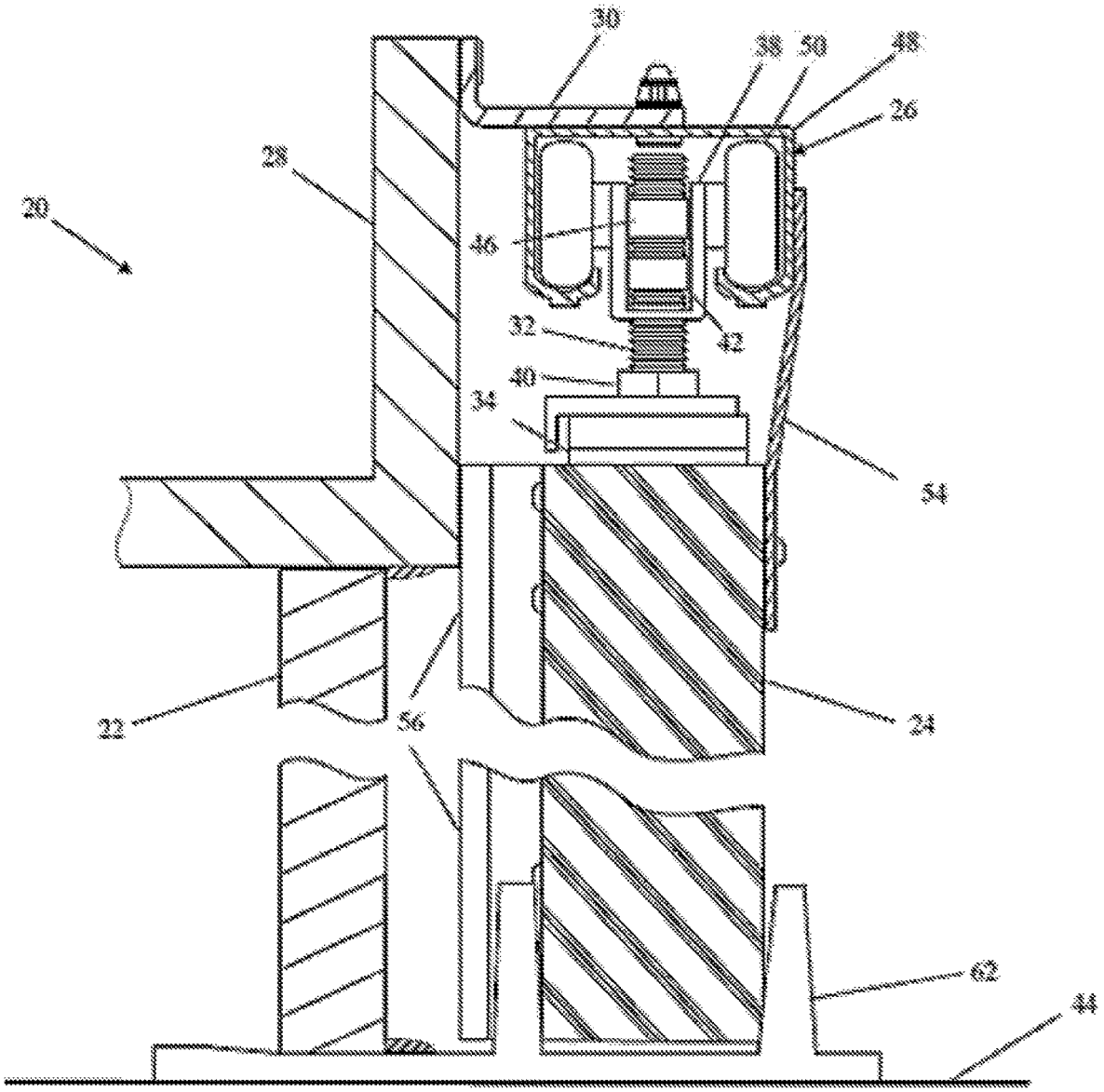
FIG. 2 is a partial cross-sectional view of the easy glide door assembly attached to the door head in front of the standard exterior door taken along line 2-2 of FIG. 1
Figure 3:
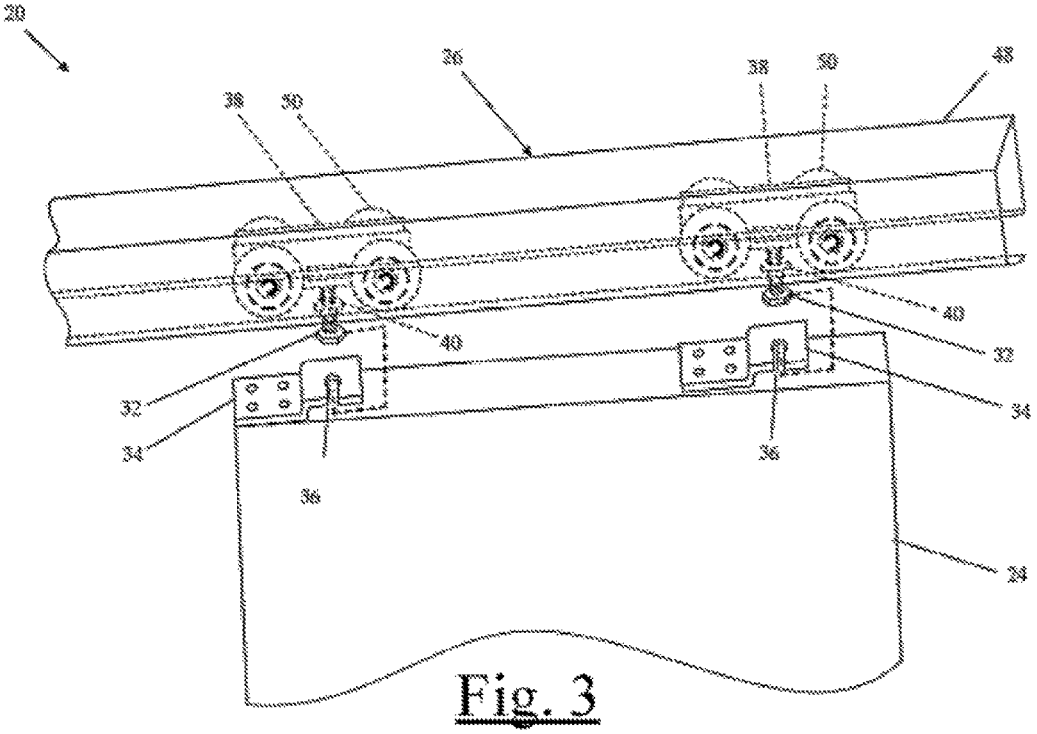
FIG. 3 is an exploded partial perspective view of the attachment of the door and the roller track system via the door bracket.
Figure 4:
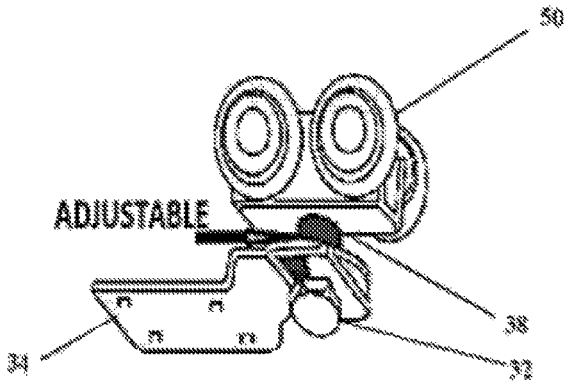
FIG. 4 is a perspective view of a door bracket and the rollers.
Figure 5:
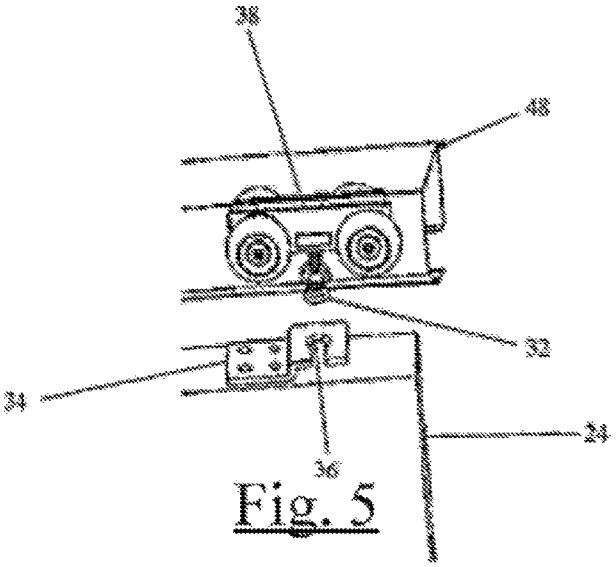
FIG. 5 is a partial perspective view of the door, the door bracket, the rollers, and the track.

FIG. 2 is a cross-sectional view taken from lines 2-2 in FIG. 1 which shows how the door 24 is installed in front of (i.e., on the exterior side of) the exterior door 22. The track system 26 is firmly attached to a door head 28 or exterior wall structure via a wall bracket 30. The wall bracket 30 could be any appropriate shape to attach the track system 26 to the door head 28. For example, an L-shaped bracket can be used to attach the track system 26 to a vertical wall, or a Z-shaped bracket to a horizontal ceiling. The door 24 is hung from a thrust bolt 32 in the track system 26 via a door bracket 34. FIG. 3 illustrates an exploded view of attachment of the door 24 and the roller track system 26 via the door bracket 34. Typically at least two door brackets 34 are firmly disposed on a top surface of the door 24. The door bracket 34 takes the form of a generally Z-shaped plate having a higher portion and a lower portion. The lower portion of bracket 34 is firmly fixed through holes on the top surface of the door 24 by screwing, welding or other suitable means. The upper portion of bracket 34 includes a notch 36. The notch 36 is configured to hook over the head of the thrust bolt 32, and a nut 40 is generally designed to fasten the door bracket 34 and the thrust holt 32 as shown in FIGS. 2 and 3.

Returning to again FIG. 2, a fixed bolt 42 is permanently attached to the track system 26. The height of the door 24 can be adjusted by turning the thrust bolt 32 so that the door 24 can keep appropriate gap between the bottom surface of the door 24 and a sill 44. A counter bolt 46 is located over the fixed bolt 42. When the counter bolt 46 is tightened to the fixed bolt 42, the counter bolt 46 can prevent the thrust bolt 32 from loosening and firmly maintain the height of the door 24.

Figure 6:
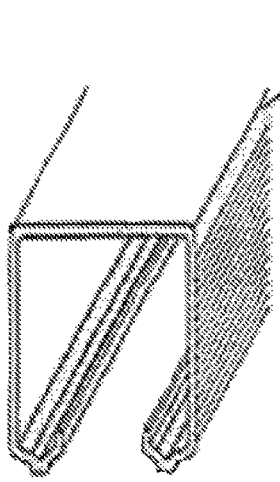
FIG. 6 is a partial perspective view of the track.
Figure 7:
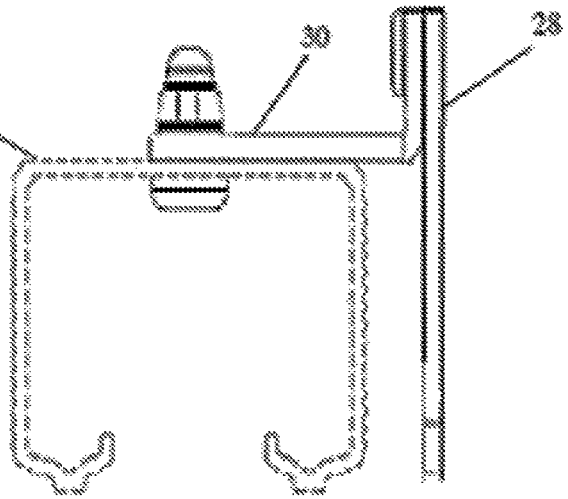
FIG. 7 is a partial side view of the track attached to the door head via the wall bracket.
Figure 8:
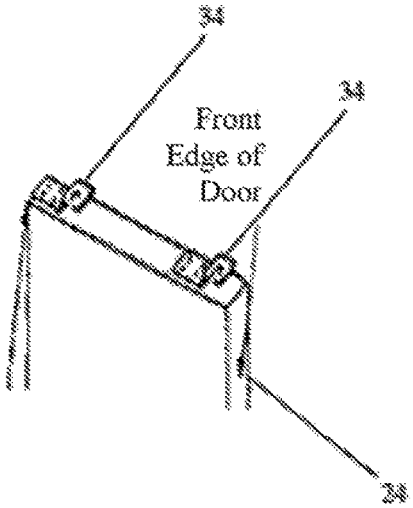
FIG. 8 is a partial perspective view of a pair of door brackets attached to the door.

FIGS. 2-7 illustrate how the track system 26 is composed to permit sliding movement of the door 24. The track system 26 generally comprises a pair of rollers 38 and a track 48. The roller 38 generally includes two pair of wheels 50, which can freely rotate on the both sides of the roller 38. The track 48 takes the form of a generally a U-shaped strut channel as shown in FIGS. 6 and 7. The rollers 38 are configured to slide inside the track 48. In both ends of channel of the track 48, a stopper 52 is disposed to prevent the roller 38 from escaping the track 48. One example of the stopper 52 could be a screw across the track 48. However, any means of preventing the roller 38 from escaping could be the stopper 52. (E.g. an end block or cap.)

Returning to FIGS. 1 and 2, a flexible top guard 54 is firmly attached to the exterior face of the door 24 adjacent its top edge. The top guard 54 extends above the door 24 and partially overlays the tack 48 to keep bugs out of the gap between the track system 26 and the door 24. Also, the top guard 54 prevents rain and dust from entering and can protect the track system 26 and the exterior door 22. The top guard is designed to closely ride against the track 48. FIGS. 1 and 2 depict a right side guard 56, which is firmly disposed along the right side edge of the door 24 to seal the gap between the door 24 and a wall. A left side guard (not illustrated) can be attached to the door 24 to accomplish a similar purpose.

Figure 9:
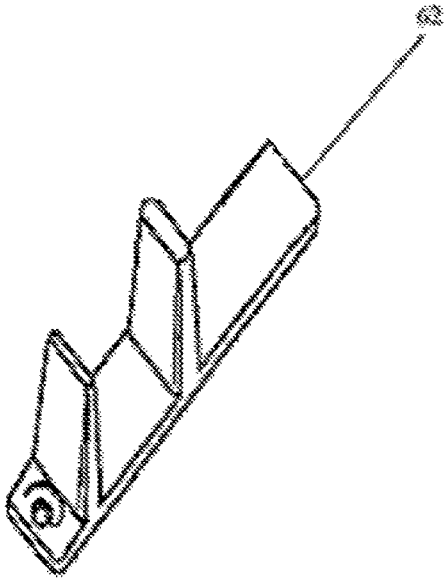
FIG. 9 is a perspective view of the lower guide.

The door assembly 20 may further include a lower guide 62 to help maintain the door 24 in a vertical orientation at all times, even when being slid open and dosed. FIGS. 1, 2 and 9 show the guide 62, which is firmly fixed in the sill 44. In particular, the guide 62 includes a generally U-shape slot that confines a bottom portion of the door 24. Furthermore, the guide 62 can prevent the door 24 from shaking by gusts of wind.

The present invention also can conveniently replace with an existing prior art storm door because the door 24 can be configured to slide right or left corresponding to a pre-installed exterior door. In FIG. 1, the door 24 is configured to slide right, but, the door 24 can be configured to slide toward the left. Thus, the present invention can be easily adapted to both left and right knob door applications Many modifications and variations of the present invention are possible in light of the above teachings and may be practiced otherwise than as specifically described while within the scope of the contemplated invention.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. Far values which are less than one, one unit is considered to be 0.0001, 0.001, 0,01 or 0.1 as appropriate. These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight. Thus, an expression in the Detailed Description of the Teachings of a range in terms of at "'x' parts by weight of the resulting polymeric blend composition" also contemplates a teaching of ranges of same recited amount of "x" in percent by weight of the resulting polymeric blend composition."

Unless otherwise stated, all ranges include both endpoints and all numbers between the endpoints. The use of "about"

or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes The omission in the following claims of any aspect of subject matter that is disclosed herein is not a disclaimer of such subject matter, nor should it be regarded that the inventors did not consider such subject matter to be part of the disclosed inventive subject matter.

The invention claimed is:

1. An assembly comprising:

a track configured to attach to a door head;

a roller configured to be received into the track so that the roller is moveably connected to the track;

an attaching member extending from the roller;

a door bracket configured to attach to a top surface of a door, the door bracket comprising a Z-shaped cross section having a lower portion and a higher portion, the lower portion is laterally offset from the higher portion, the lower portion is configured to be fastened to the top surface of the door, the higher portion comprising a slot having an opening that is configured to hook over the attaching member, the higher portion having a bottom surface that is spaced apart from and generally parallel to the top surface of the door after the lower portion is fastened to the top surface of the door; and a top guard attached to a front surface of the door, the top guard extends above the top surface of the door and is configured to directly contact the track;

wherein the door is configured to be slid along a length of the track, and the top guard is configured to ride against the track when the door is slid along the length of the track.

2. The assembly of claim 1, wherein after the opening is hooked over the attaching member, the attaching member is located in between the bottom surface of the higher portion and the top surface of the door, and is laterally offset from the lower portion.

3. The assembly of claim 1, wherein the door bracket comprises an edge, the opening extends through the edge so that the opening has an open end, the open end is configured to be hooked over the attaching member, the attaching member is a bolt.

4. The assembly according to claim 3, wherein the attaching member extends along a longitudinal axis, and after the opening is hooked over the attaching member, the longitudinal axis of the attaching member is generally centered between the front surface and a rear surface of the door.

5. The assembly of claim 1, wherein the roller comprises two pair of wheels.

6. The assembly of claim 1, wherein the roller comprises a pair of front wheels and a pair of rear wheels, wherein the pair of front wheels comprises a front outboard wheel and a front inboard wheel, wherein the pair of rear wheels comprises a rear outboard wheel and a rear inboard wheel, wherein the attaching member is located between the pair of front wheels and the pair of rear wheels, wherein the attaching member is located between the front outboard wheel and the rear outboard wheel, and wherein the attaching member is located between the front inboard wheel and the rear inboard wheel.

7. The assembly of claim 1, wherein the attaching member is a thrust bolt, wherein the assembly comprises a fixed bolt and a counter bolt located over the fixed bolt, wherein the counter bolt is configured to be tightened to the fixed bolt to prevent the thrust bolt from loosening.

8. The assembly of claim 1, wherein the assembly comprises a lower track that is configured to be fixed to a floor or sill, the lower track has a U-shape that a bottom portion of the door is configured to fit into.

9. The assembly of claim 1, wherein the slot is U-shaped and is elongated in a direction that is different than a direction that the door is configured to be slid along.

10. The assembly according to claim 1, wherein the lower portion is laterally offset from the higher portion in a direction that the door is configured to slide along in the track.

11. The assembly according to claim 1, wherein after the lower portion is fastened to the top surface of the door, a footprint of the higher portion is free from overlapping a footprint of the lower portion.

12. The assembly according to claim 1, wherein the attaching member extends along a longitudinal axis, and after the opening is hooked over the attaching member, the longitudinal axis of the attaching member is generally centered between the front surface and a rear surface of the door.

13. The assembly of claim 12, wherein after the opening is hooked over the attaching member, the attaching member is located in between the second portion of the door bracket and the top surface of the door.

14. The assembly according to claim 12, wherein after the opening engages the attaching member, the attaching member is laterally offset from the first portion.

15. The assembly according to claim 1, wherein the attaching member extends along a longitudinal axis, and after the opening engages the attaching member, the longitudinal axis of the attaching member is generally centered between a front and rear surface of the door.

16. An assembly comprising:

a track configured to attach to a door head;

a roller configured to be received into the track so that the roller is moveably connected to the track;

an elongated attaching member extending along a longitudinal axis, the attaching member extending from the roller in a direction of a top surface of the door;

a door bracket comprising a Z-shaped cross section having a lower portion and a higher portion, the higher portion is laterally offset from the lower portion, the lower portion is configured to attach to the top surface of a door, the higher portion comprising an opening that is configured to engage the attaching member; and a top guard configured to be attached to a front surface of the door, the top guard is configured to directly contact the track, wherein the door is configured to be slid along a length of the track, wherein the top guard is configured to extend above the top surface of the door and ride against the track when the door is slid along the length of the track, and wherein after the opening engages the attaching member, the longitudinal axis of the attaching member is generally centered between a front and rear surface of the door.

17. The assembly according to claim 16, wherein after the opening engages the attaching member, the attaching member is laterally offset from the lower portion, and wherein the higher portion is free from being in direct contact and/or fastened to the top surface of the door.

* * * * *